United States Patent [19]

Rothwell et al.

[11] 4,362,969

[45] Dec. 7, 1982

[54] HIGH INTENSITY DISCHARGE LAMP INCLUDING ARC EXTINGUISHING MEANS

[75] Inventors: Harold L. Rothwell, Rowley; W. Calvin Gungle, Danvers, both of Mass.

[73] Assignee: GTE Products Corporation, Stamford, Conn.

[21] Appl. No.: 257,847

[22] Filed: Apr. 27, 1981

[51] Int. Cl.[3] ..... H01J 7/44

[52] U.S. Cl. ..... 315/73; 315/119; 337/413

[58] Field of Search ..... 315/73, 74, 119; 337/413, 401, 30

[56] References Cited

U.S. PATENT DOCUMENTS

| | | | |
|---|---|---|---|
| 3,211,950 | 10/1965 | Cardwell | 315/74 |
| 4,013,919 | 3/1977 | Corbley | 315/73 |
| 4,195,251 | 3/1980 | Bamberg | 315/73 |
| 4,233,542 | 11/1980 | Oostvogels et al. | 315/73 |

*Primary Examiner*—Harold A. Dixon

*Attorney, Agent, or Firm*—William H. McNeill

[57] ABSTRACT

An arc extinguishing means for a high intensity discharge lamp comprises a meltable fuse wire a portion of which is surrounded by a refractory hollow sleeve of larger diameter than the fuse wire. The remaining volume of the sleeve is substantially filled with a pyrophoric material which, at an operating temperature available within the lamp, will spontaneously ignite in the presence of oxygen and generate sufficient heat to melt the fuse wire and thus open the circuit, extinguishing the lamp.

6 Claims, 5 Drawing Figures

HIGH INTENSITY DISCHARGE LAMP INCLUDING ARC EXTINGUISHING MEANS

TECHNICAL FIELD

This invention relates to high intensity discharge lamps of the type employing an arc tube within an outer envelope. Arc extinguishing means are included within the outer envelope of the lamp for interrupting power to the arc tube in the event of breakage of the outer envelope.

BACKGROUND ART

High intensity discharge (HID) lamps such as mercury vapor, metal halide and high pressure sodium lamps, because of their high luminous efficacy, excellent lumen maintenance, relative low cost of light, good optical efficiency and ease of installation have been in general use for many years and are in increasing demand today. It has recently been publicized that, under certain conditions, these HID lamps may present a potential health hazard.

The light emitting member of these lamps, namely, the quartz arc tube containing mercury vapor or metal halide, and the alumina high pressure sodium discharge tube, all contain mercury as at least one of the constituent fill components. The mercury vapor lamp arc tube uses only mercury as the fill component (except for argon starting gas) and the resulting lamp discharge yields the well known mercury high pressure line spectrum with infrared, visible and ultraviolet radiation. The metal halide tube uses mercury plus combinations of various metal halide compounds as the fill components in addition to argon starting gas. The resulting spectrum will be characteristic of the metal introduced, augmented by the mercury line spectrum. The high pressure sodium lamp is filled with mercury and sodium in addition to starting gases of argon, xenon or neon or mixtures thereof. The spectrum of the discharge of this lamp is characteristic of high pressure sodium augmented by the line spectrum of mercury. Therefore, although ionized and excited mercury atoms are not the primary light producing species in metal halide and high pressure sodium arc tubes and lamps, sufficient mercury ionization and excitation occurs to produce visible and ultraviolet radiation of the characteristic mercury spectrum.

The characteristic mercury spectral lines produced by the discharges of the foregoing types of lamps produce ultraviolet radiation in the 200–297 nanometer range. Ultraviolet radiation in this range is potentially harmful. For example, conjuctivitis, an inflammation of the conjunctivae, will cause visual incapacitation and is caused by exposure to 250–297 nanometer radiation. Conjunctivitis when inflicted by exposure to the ultraviolet radiation is insidious as its symptoms do not apear until 2½ to 12 hours after exposure to such radiation. Numerous cases of ultraviolet radiation exposure causing abiotically produced cataracts of the eye lens have been reported. Even when such ultraviolet producing sources are viewed from considerable distances eye injuries can occur by ocular absorption.

Hermetically sealed outer glass envelopes are usually used to surround the light emitting tubes of HID lamps. This is done for three main reasons: (a) to obtain proper warm up and operating vapor pressures of the fill components by providing an inert gas or vacuum atmosphere between the discharge tube and the outer envelope, (b) to prevent the slow deterioration, due to oxidation, of the discharge tube lead-in wires and (c) to prevent the lamp from radiating the harmful ultraviolet energy produced by the inner tube.

With respect to point (c), the glass composition of the outer envelope is chosen so as to achieve absorption of the ultraviolet range causing known harmful effects. Therefore, when the outer glass envelope is intact, the harmful ultraviolet radiation emitted by the discharge tube is absorbed. When for one reason or another, the glass envelope is broken the hermetically sealed light emitting discharge tubes of these lamps will continue to operate for tens to hundreds of hours and will now emit their harmful ultraviolet radiation to the surrounding areas thus creating a health hazard to persons in those areas. An increasing number of HID lamps are used indoors where lamps, if operating with broken outer envelopes, will be of particular danger because of the likelihood of lamp installations in close proximity to people.

Various solutions to this problem have been proposed by the prior art and these solutions can broadly be defined as: 1. means sensitive to an increase in oxygen in the outer envelope, 2. means sensitive to a change in pressure in the outer envelope, and 3. spring switch means held together by the actual configuration of the glass outer envelope.

Examples of proposed solutions under item 1. above included U.S. Pat. Nos. 3,262,012 and 4,208,614 wherein an oxidizable filament is employed in the outer envelope which will burn through in the event the outer envelope breaks and admits air; U.S. Pat.No. 4,195,251 and U.S.S.R. Pat. No 267753 which describe pyrophoric means for opening the circuit and extinguishing the arc.

An example of an item 2. pressure sensitive device can be found in U.S. Pat. No. 4,143,301 in which a bellows switch is used in conjunction with an oxidizable filament.

An item 3. contact switch is disclosed in U.S. Pat. No. 4,156,830.

While all of the above described solutions will work to a greater or lesser degree, problems exist with all of them.

Time is a concern with the oxidizable filament approach; the above-cited U.S. Pat. No. 4,208,614 reciting a burn through time of 25 to 105 seconds. Also, such devices are fragile and can suffer from premature failures.

The previously disclosed pressure sensitive devices are bulky and expensive and also employ, in conjunction therewith, an oxidizable filament.

The contact devices do not guarantee operation if the outer envelope is merely punctured at a spot remote from the switch.

DISCLOSURE OF INVENTION

It is, therefore, an object of this invention to obviate the disadvantages of the prior art.

It is another object of the invention to provide a simple, rugged, reliable and fast acting arc extinguishing device.

These objects are accomplished, in one aspect of the invention, by the provision, within a high intensity discharge (HID) lamp, of a circuit opening, and thus arc extinguishing, fuse which comprises a meltable fuse wire having a given length, a given diameter and a given melting point. At least a portion of the length is surrounded by a hollow sleeve having an internal dimension larger than the given diameter of the wire. A pyrophoric material substantially fills the remaining volume of the sleeve.

In the event of rupture of the outer envelope of the HID lamp and the entrance thereinto of atmospheric oxygen, the pyrophoric material will spontaneously ignite and the heat generated thereby confined by the refractory sleeve will melt the fuse wire and cause it to break apart, thus opening the circuit and extinguishing the arc discharge.

This device is simple and inexpensive to produce. It is a rugged device not subject to premature failures.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
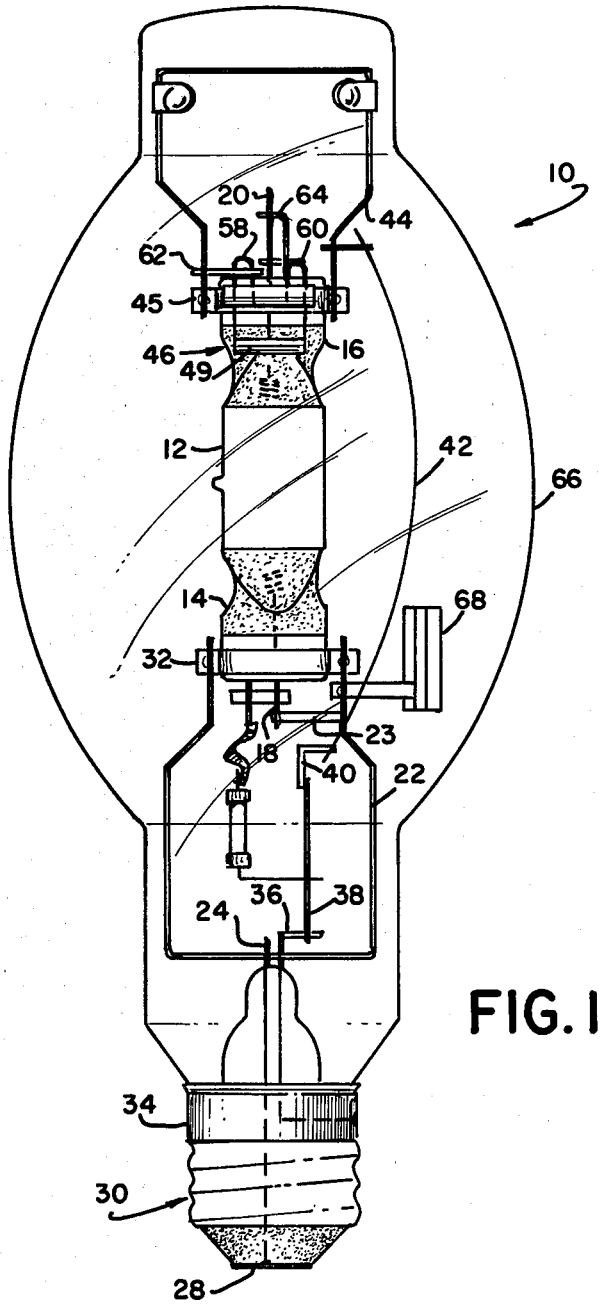
FIG. 1 is a diagrammatic view of an HID lamp employing the invention.

Referring now to the drawings with greater particularity, there is shown in FIG. 1 a high intensity discharge lamp 10 which comprises an inner arc discharge tube 12 of, for example, fused quartz. The ends 14, 16 of tube 12 are sealed around current carrying electrodes 18, 20.

Electrode 18 is attached to metal frame 22 by tab 23. Frame 22 is attached to metal lead-in 24 which is sealed into the glass press 26 and extends to the center conductor 28 of base 30. The arc tube 12 is affixed to frame 22 by metal retaining band 32.

The outside conductor 23, of base 30, is connected to metal lead-in 36, which also is sealed in glass press 26. Lead-in 36 is connected to metal leads 38 and 40 and flexible connector 42. The other end of connector 42 is connected to metal upper frame 44 which is mounted to arc tube retaining band 45. Serially connected between upper frame 44 and electrode 20 is a non-power consuming lamp extinguishing means 46.

Figure 4:
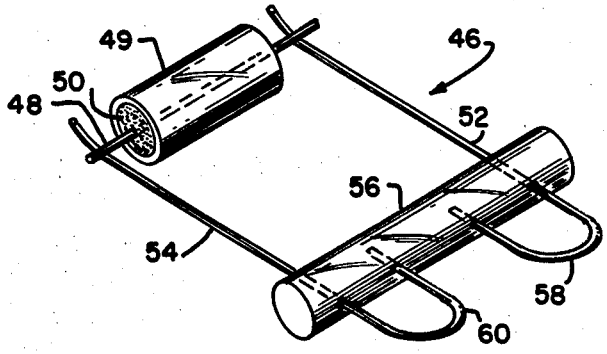
FIG. 4 is a perspective view of one embodiment of the fuse of the invention.

The lamp extinguishing means 46 (see FIG. 4) comprises an electrically conductive, meltable fuse wire 48 which, preferably, is formed from an Al-Zr alloy having a melting point about 580° C. Fuse wire 48 can have a diameter of 0.025" (0.625 mm) and a length of about 0.4" (10 mm). At least a portion of the length of fuse wire 48 is surrounded by a refractory hollow sleeve 49 of a suitable material, such as quartz. Sleeve 49 has an internal dimension larger than the diameter of fuse wire 48, say, a diameter of 0.08" (2 mm) and a length of 0.16" (4 mm). A pyrophoric material 50 substantially fills the remaining volume of sleeve 49. Preferably, the pyrophoric material 50 comprises about 10 to 20 mg of zirconium shreds about 0.0005"×0.001" (0.0125 mm×0.025 mm) with the remaining volume being zirconium power having an average particle size of about 3μ.

Electrical lead-wires 52 and 54 are attached to the ends of fuse wire 48 and extend therefrom. An electrically insulating lead-wire supporting bridge 56 of a suitable material, e.g., quartz, engages the intermediate section of lead-wires 52 and 54. Preferably, the free ends 58 and 60 of these lead-wires are folded back and inserted also in bridge 56 to further increase the structural rigidity of means 46.

Figure 2:
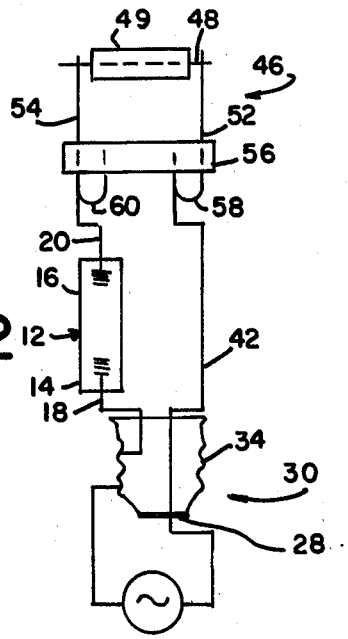
FIG. 2 is a circuit diagram thereof.
Figure 3:
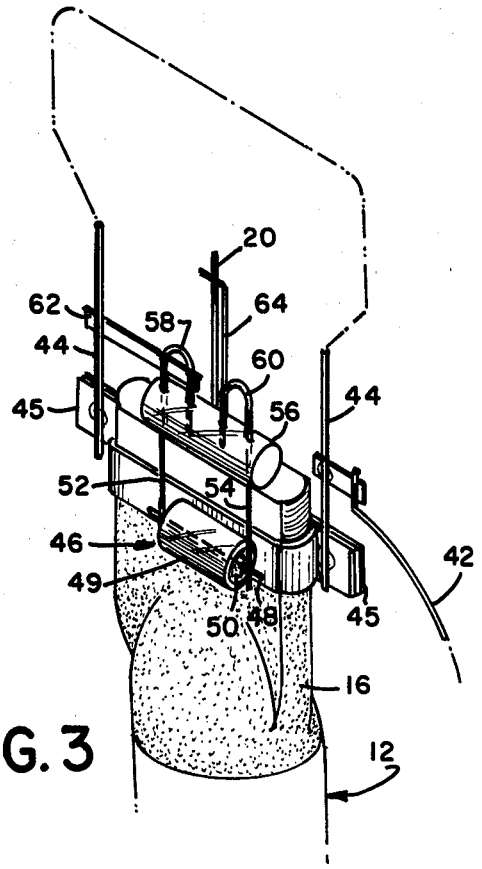
FIG. 3 is a perspective view of a fuse of the invention and a mounting arrangement therefor.

Electrical connection and physical positioning of means 46 can be made by attaching frame 44 to one of the lead-wires of means 46, e.g., lead-wire 52, as by tab 62 (see FIGS. 1 and 3). The other lead-wire, 54, is attached to electrode 20, as by connector 64. These connections are shown schematically in FIG. 2.

Lamp extinguishing means 46 is mounted as shown, i.e., adjacent the press seal of the arc tube 1, so that during operation of the lamp the fuse body is maintained at a temperature of about 400° C. Tests have shown that at this temperature the zirconium shreds will rapidly oxidize and the zirconium powder will spontaneously ignite and flash when the enclosing environment within the outer jacket 66 is changed from inert to air. Normally, the environment surrounding the arc tube is nitrogen which does not react with the fuse. In the event of rupture of the outer envelope 66, the displacement of nitrogen with air introduces sufficient oxygen to ignite the zirconium powder which is sustained for several seconds by the zirconium shreds and the confining sleeve 49. The heat generated by the combustion is sufficient to raise the temperature of the fuse wire 48 above its melting point (≈580° C.) which causes the fuse wire 48 to break apart and burn back until no sustaining current path is possible.

Since the lamp extinguishing means 46 is oxygen sensitive, at least one $BaO_2$ getter, 68, is provided within outer envelope 66 to absorb any oxygen that remain therewithin after exhausting or is generated therewithin during operation of the lamp, as is conventional in the art.

Figure 5:
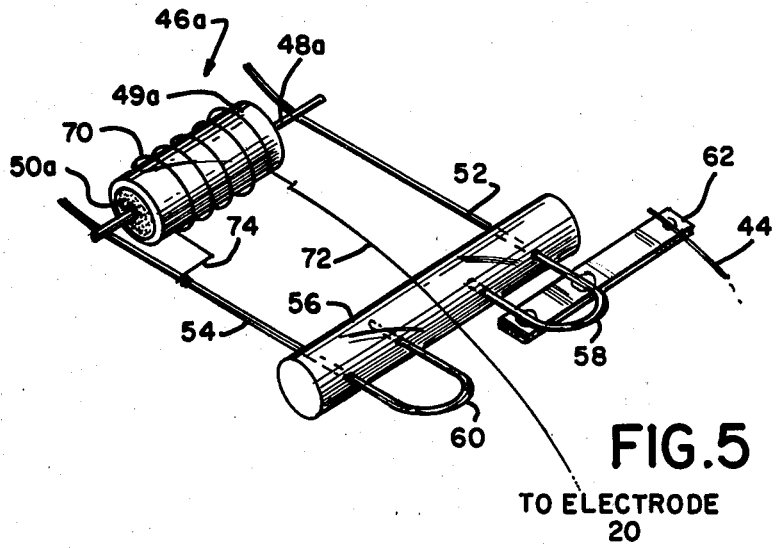
FIG. 5 is a perspective view of an alternate embodiment of the invention.

An alternate embodiment of the invention is shown in FIG. 5. Herein, the sleeve **49*a* of means 46*a* is surrounded by a tungsten coil 70 which is employed to maintain the temperature of the fuse body. Incorporating the filament provides additional protection and guarantees activation in the event the outer jacket 66 is broken before the arc source is turned on. As can be seen from FIG. 5 the coil 70 has one of its ends, 74, connected to lead-wire 54 and the other end, 72, connected to electrode 20, thus including coil 70 as a series element in the lamp circuitry. Since coil 70** is a resistance element, it will, of course, consume power.

Thus, there is provided a novel lamp extinguishing means which is simple, reliable, and inexpensive. In its preferred embodiment it performs its function as a non-power consuming element.

While there have been shown and described what are at present considered the preferred embodiments of the invention, it will be apparent to those skilled in the art that various changes and modifications can be made herein without departing from the scope of the invention as defined by the appended claims.

We claim:

1. A high intensity discharge lamp having:

an inner arc tube having at least two electrodes between which a discharge takes place to produce visible light and ultraviolet radiation;

and an outer envelope substantially transparent to said visible light and substantially opaque to said ultraviolet radiation, said outer envelope containing an inert atmosphere which is substantially oxygen free;

means external of said outer envelope for connecting said lamp to a source of electrical power;

circuit means within said outer envelope electrically connecting said electrodes to said means external of said outer lamp;

and lamp extinguishing means for opening said circuit in the event of rupture of said outer envelope and the entrance of oxygen thereinto, said lamp extinguishing means being serially connected between one of said electrodes and said means external of said outer envelope and being characterized by a fuse comprising: a meltable fuse wire have a given melting point, a given diameter and a given length, at least a portion of said given length being surrounded by a refractory hollow sleeve having an internal dimension larger than said given diameter; a pyrophoric material substantially filling the remaining volume of said sleeve; and a tungsten, heat generating coil serially connected between said fuse wire and said one electrode, said coil surrounding said sleeve.

2. The lamp of claim 1 wherein said meltable fuse wire has a melting point of about 580° C.

3. The lamp of claim 2 wherein said meltable fuse wire is formed from an alloy of aluminum and zirconium.

4. The lamp of claim 2 or 3 wherein said pyrophoric material comprises zirconium shreds and zirconium powder.

5. The lamp of claim 4 wherein said zirconium powder has a particle size of about 3 microns.

6. The lamp of claim 4 wherein said refractory hollow sleeve is quartz.

* * * * *